US006736765B2

(12) United States Patent
Wallace et al.

(10) Patent No.: US 6,736,765 B2
(45) **Date of Patent: *May 18, 2004**

(54) WEIGHT LIFTING DEVICE

(75) Inventors: Richard S. Wallace, Thousand Oaks, CA (US); Ronald S. Gibson, Valencia, CA (US)

(73) Assignee: Precor Strength Incorporated, SunValley, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/071,765

(22) Filed: May 1, 1998

(65) Prior Publication Data

US 2001/0049324 A1 Dec. 6, 2001

(51) Int. Cl.[7] ..... A61B 21/072
(52) U.S. Cl. ..... 482/106; 482/93
(58) Field of Search ..... 482/50, 93, 106–110; D21/680

(56) References Cited

U.S. PATENT DOCUMENTS

| | | | | |
|---|---|---|---|---|
| 1,047,212 A | | 12/1912 | Hamilton | |
| 3,219,343 A | * | 11/1965 | Steiner | 482/106 |
| 3,572,702 A | | 3/1971 | Dorn | |
| 3,771,785 A | | 11/1973 | Speyer | |
| 4,079,932 A | | 3/1978 | Schuetz | |
| 4,199,140 A | * | 4/1980 | Ferretti | 482/106 |
| D274,283 S | | 6/1984 | Wright | |
| 4,673,179 A | | 6/1987 | Pengler | |
| 4,880,229 A | * | 11/1989 | Broussard | 482/108 |
| 5,137,502 A | | 8/1992 | Anastasi | |
| 5,344,375 A | | 9/1994 | Cooper | |
| D354,322 S | | 1/1995 | Vodhanel, Jr | |

(List continued on next page.)

OTHER PUBLICATIONS

Roberts Big Wheel 110 LB Barbell—Dumbbell Combination Brochure, 1967.*
Iron Grip Brochure: "First We Reinvented The Wheel, Now, We've Perfected It", Apr. 10, 1997.*
Cease and Desist letter from Iron Grip to Icarian Fitness Group dated Jan. 8, 1999.
Letter from Iron Grip to Icarian Fitness Group dated Feb. 10, 1999 disclosing drawings.
Internet printout from www.irongrip.com, viewed and printed on Jul. 19, 2001.
*Check Out Iron Grip's New Urethane Olympic Plates , National Fitness Trade Journal* (Winter 1997).
Product brochure from Iron Grip Barbell Company (date unknown).
Product brochure from Iron Grip Barbell Company on urethane coated weight plates and olympic bars (date unknown).

*Primary Examiner*—John Mulcahy

(57) ABSTRACT

A weight plate for use with a barbell or dumbbell which incorporates a plurality of handgrips formed near the peripheral surface of the weight plate. The handgrips have a transverse width and radial height sized to provide a convenient gripping point for individuals with smaller hands, such as women, children, or smaller men. These small circumference handgrips are indented from the outside edges of the weight plate to allow for more convenient manipulation of the weight when the weight abuts against a solid obstruction, such as another weight plate on a weight stack. This indentation of the hand grips also provides protection for the hands and fingers of a weight lifter manipulating the weight plate in a weight lifting environment. The location of the handgrips of the present invention also facilitate the lifting and transport of the weight plate in the weight lifting environment, by reducing the stresses on the weight lifter's shoulder joints.

22 Claims, 9 Drawing Sheets

U.S. PATENT DOCUMENTS

D355,007 S 1/1995 Rojas et al.
5,421,797 A 6/1995 Fletcher
D374,047 S 9/1996 Thielemann
5,692,996 A * 12/1997 Widerman ..... 482/108
5,853,355 A 12/1998 Standish
D406,183 S * 2/1999 Zovich ..... D21/680
D409,695 S * 5/1999 Rojas et al. ..... D21/680
6,436,015 B1 * 8/2002 Frasco et al. ..... 482/106

* cited by examiner

WEIGHT LIFTING DEVICE

BACKGROUND OF THE INVENTION

It is well known that the muscle mass and strength of an individual can be greatly increased through repetitive weight lifting exercises, commonly known as "pumping iron." Various weighted devices have been known for many years for use by individuals in the course of body building exercises. The best known of these devices are barbells and/or dumbbells, both of which are exceedingly well-known in the art.

Barbells and dumbbells are typically constituted by weighted elements interconnected by a bar or rod. The central section of the rod or bar is sized so that it may be gripped by an individual's hands, thus allowing the individual to lift and move the weighted elements in a desired fashion. The dumbbell is generally a smaller version of the barbell, sized to be manipulated by a single hand. Virtually all muscle groups in the human body can be exercised using barbells and/or dumbbells.

The weighted elements used in conjunction with dumbbells and barbells come in numerous shapes and sizes, with many variations shown in the prior art. For example, a 1912 patent, U.S. Pat. No. 1,047,212 to Hamilton, discloses a physical developer comprised of a plurality of disk-shaped weights, each weight provided with a central aperture, and a cross-bar across the aperture to serve as a handle. The developer is used to exercise the muscles of the lower neck, spine and lower limbs, and the individual weights can be used as hand weights or dumbbells. A separate handle can also be attached to the periphery of an individual weight to allow the weight to be used as an "indian club."

U.S. Pat. No. 3,572,702 to Dorn discloses a hollow barbell weight that can be filled with sand, cement or some other cheap filling material. Once filled with the desired material, the hollow weight is sealed closed with a plug, which is secured in place by a circumferential band of rubber around the barbell weight. The barbell weight has a central passage by which it fits onto a bar.

U.S. Pat. No. 3,771,785 to Speyer discloses a barbell weight having a specially designed "bore" by which the weight may be secured onto a barbell bar without removing a collar or other weight retaining device.

U.S. Pat. No. 5,137,502 to Anastasi et al ("the '502 patent") discloses a barbell weight plate having a pair of diametrically opposed, elongated oval openings disposed parallel to one another and equidistant from the central circular opening.

U.S. Pat. No. DES 354,322 to Vodhanel, Jr., discloses a barbell weight plate having a plurality of openings in the weight plate body, with these openings located adjacent the central bore of the weight plate.

U.S. Pat. No. DES 355,007 to Rojas et al ("the '007 patent") discloses a barbell weight plate having a pair of diametrically opposed, elongated oval-shaped openings disposed parallel to one another and equidistant from the central circular opening. In addition, the '007 patent discloses a multi-sided "ring" at the periphery of the weight, with the ring and the central portion of the weight being the thickest sections of the weight plate.

U.S. Pat. No. DES 374,047 to Thielemann discloses a hand-held exercise weight incorporating a handgrip with indentations corresponding to the fingers and thumb of the holder.

SUMMARY OF THE INVENTION

While barbells and barbell weight plates are well known in the art, the present invention identifies and solves a number of significant disadvantages inherent in prior art barbell weight plates when used in an actual weight lifting environment.

One significant flaw inherent in prior art barbell weight plates is the lack of any protection for a weight lifter's hand and/or fingers when lifting and/or moving the weight plate. For example, in the '502 patent disclosure the weight lifter desirably grips the weight plate at the outer periphery, with his or her fingers or thumb curling around the outer periphery of the weight plate and into the openings. When the fingers or thumb are in this position, and the side or edge of the weight plate comes in contact with a solid obstruction, the weight lifter's fingers or thumb may be "pinched" or crushed between the obstruction and the side of the weight plate.

This flaw becomes even more apparent when observing how weight lifters maneuver weight plates in an actual weight lifting environment. Where multiple weight plates are being loaded onto a barbell or weight lifting machine, the weight lifter will typically grasp the plate by the handgrips, position the plate on the cylindrical support bar, and then push the weight plate until it comes in contact with the machine, bar-stop or other weight plates already loaded. Typically, the force the weight lifter uses to push the weight plate onto the bar is far more than the amount actually required to move the weight along the bar, which results in the weight plate striking the machine, bar-stop or already loaded weight plate at a relative high speed, often with a resounding "crash." Where the cylindrical support bar is biased or tilted such that the weight plate slides down the bar due to gravitational forces, the moving weight plate will often strike the stationary object(s) at even higher speeds.

When a weight plate is moving in this manner, it can possess a tremendous amount of kinetic energy. If the weight lifter is distracted or not paying attention to the positioning of his or her hands, his or her hands and/or fingers can accidentally come between the moving weight plate and the stationary object. Accordingly, there exists a need in the art for a weight plate that provides protection for the hands and/or fingers of a weight lifter who is manipulating the weight plate.

Another significant flaw in existing weight plates becomes apparent when the weight plate is resting on its face on a flat surface (in the prone position). Because the entire periphery of the weight plate is in contact with the surface, the weight lifter must either work his or her fingers under the weight plate, or must grasp the sides of the plate with sufficient force so that friction between the weight lifter's hand and/or fingers and the circumference of the weight plate will be greater than the force of gravity. The weight lifter must then simultaneously suspend a portion of the weight plate in the air with his or her hand while positioning his or her other hand under the plate. Often, the weight plate will slip and fall two or three times before the weight lifter can successfully lift the weight. Accordingly, there exists a need in the art for a weight plate that can be easily lifted from a prone position by a weight lifter, preferably using only a single hand.

A similar problem exists when weight plates are placed side by side (in a prone position or "stacked") on a barbell or weight rack. In order to remove a weight from such a weight stack or rack, a weight lifter must again attempt to move the weight plate by grasping the weight about the outer periphery, and then forcing his or her fingers into the gap between the weight plates. Where the weight plates are located on a tilted weight bar or rack, the difficulty with moving such weights is exacerbated. Accordingly, there exists a need in the art for a weight plate that can be easily and conveniently lifted from a weight stack or rack.

Another flaw in existing weight plates relates to the large dimensions of the gripping surfaces incorporated into prior art weight plates, such as those disclosed in the '502 patent. In general, weight plates are constructed in standard sizes: 2.5, 5, 10, 25, 35, 45, and as much as 100 pounds per plate. Alternatively, they may come in metric sizes, typically 1.25, 2.5, 5, 10, 15, 20 and 45 kilograms. This mixture of sizes allows weight lifters to "mix and match" the weights on the barbell, thereby obtaining a desired weight resistance on the bar. However, because an increasing amount of material must be incorporated into the larger size weight plates, larger weight plates are typically proportionately larger than their smaller counterparts, with proportionately larger gripping surfaces.

The large dimension of such oversized gripping surfaces was not an important consideration while weight lifting was typically a male-dominated sport. However, in the past decades, gyms and other exercise facilities have experienced a dramatic increase in the number of female members, many of whom excel at weight lifting and "pumping iron." Because a woman's hand is typically smaller than a man's hand, however, women often find it difficult to grasp and carry the heavier weight plates dimensioned for the larger hands of male weight lifters. Accordingly, there exists a need in the art for a larger weight plate which incorporates gripping surfaces convenient for use by individuals with smaller hands and/or fingers.

These and other problems are solved by the present invention, which incorporates one or more handgrips integrally into a disk shaped weight plate for use with barbells or dumbbells. These handgrips are dimensioned such that the transverse thickness of the handgrips is less than the transverse thickness of the weight plate such that, when the face of the weight plate contacts a solid obstruction, the handgrip will not also directly contact the obstruction.

In a preferred embodiment, the weight plate incorporates three handgrips located adjacent to the periphery of the weight plate. The sides of the weight plate overlap the sides of the handgrip sufficiently to allow the weight plate to impact a solid obstruction without causing damage to the hands and/or fingers of the weight lifter. Furthermore, the reduced transverse width and radial height of the handgrip allow an individual with very small hands to grasp and safely carry even the heaviest of weight plates by the handgrips.

Moreover, the reduced transverse width of the handgrip allows a weight lifter to conveniently lift the weight even when the weight is lying prone on a horizontal surface or is abutting against a solid obstruction or adjacent weight plate. This is because the handgrips in the disclosed weight plate do not directly contact the horizontal surface or solid obstruction when the weight plate is in the prone position, thereby allowing the weight lifter to easily grip the handgrips with his or her fingers and/or hands, and conveniently lift the weight plate.

In addition, because the handgrips of the preferred embodiment are positioned adjacent to one another at an oblique angle, this positioning allows a weight lifter to heft the weight with his or her hands positioned in a non-vertical orientation, thereby allowing the weight lifter's back muscles to carry a larger proportionate share of the lifting load, and reducing stress on the weight lifter's shoulder muscles and joints. Not only does this allow the weight lifter to lift the weight easier, or to more easily lift a larger weight plate, but the positioning and size of the handgrips also allows the weight plate to be used as an individual exercise device, if so desired.

Furthermore, because one embodiment of the generally circular circumference of the weight lifting plate incorporates generally flat surfaces adjacent the handgrips, these flat surfaces tend to resist circumferential rolling of the weight plate, and thereby serve to limit unwanted rotation and/or movement of a barbell and/or dumbbell when the barbell and/or dumbbell has been placed on a flat surface in the exercise facility.

It is an object of the present invention, therefore, to provide an improved weight plate that may be used alone or in conjunction with barbells and/or dumbbells.

It is a further object of the present invention to provide a weight plate that furnishes protection for a weight lifter's hands and/or fingers when the weight plate is lifted and/or maneuvered.

It is a further object of the present invention to provide a weight plate that can be easily lifted from a prone position.

It is a further object of the present invention to provide a weight plate that can be easily and conveniently lifted from a horizontal or tilted weight stack or rack.

It is a further object of the present invention to provide a weight plate that allows individuals with small hands to safely lift and move the weight plate.

It is a further object of the present invention to provide a weight plate that allows a weight lifter to use both his or her shoulder and back muscles to safely lift the weight when holding the weight plate by the handgrips, thereby allowing the individual to more easily lift the weight or lift heavier weights without straining his or her shoulder muscles and joints.

Further features and advantages of the invention will be described or will become apparent in the course of the following detailed description and from an examination of the accompanying drawings.

BRIEF DESCRIPTION OF THE DRAWINGS

The invention will be better understood from the ensuing detailed description and the accompanying drawings of the preferred embodiment, which are provided by way of example only, of which.

DETAILED DESCRIPTION OF A PREFERRED EMBODIMENT

Figure 1:
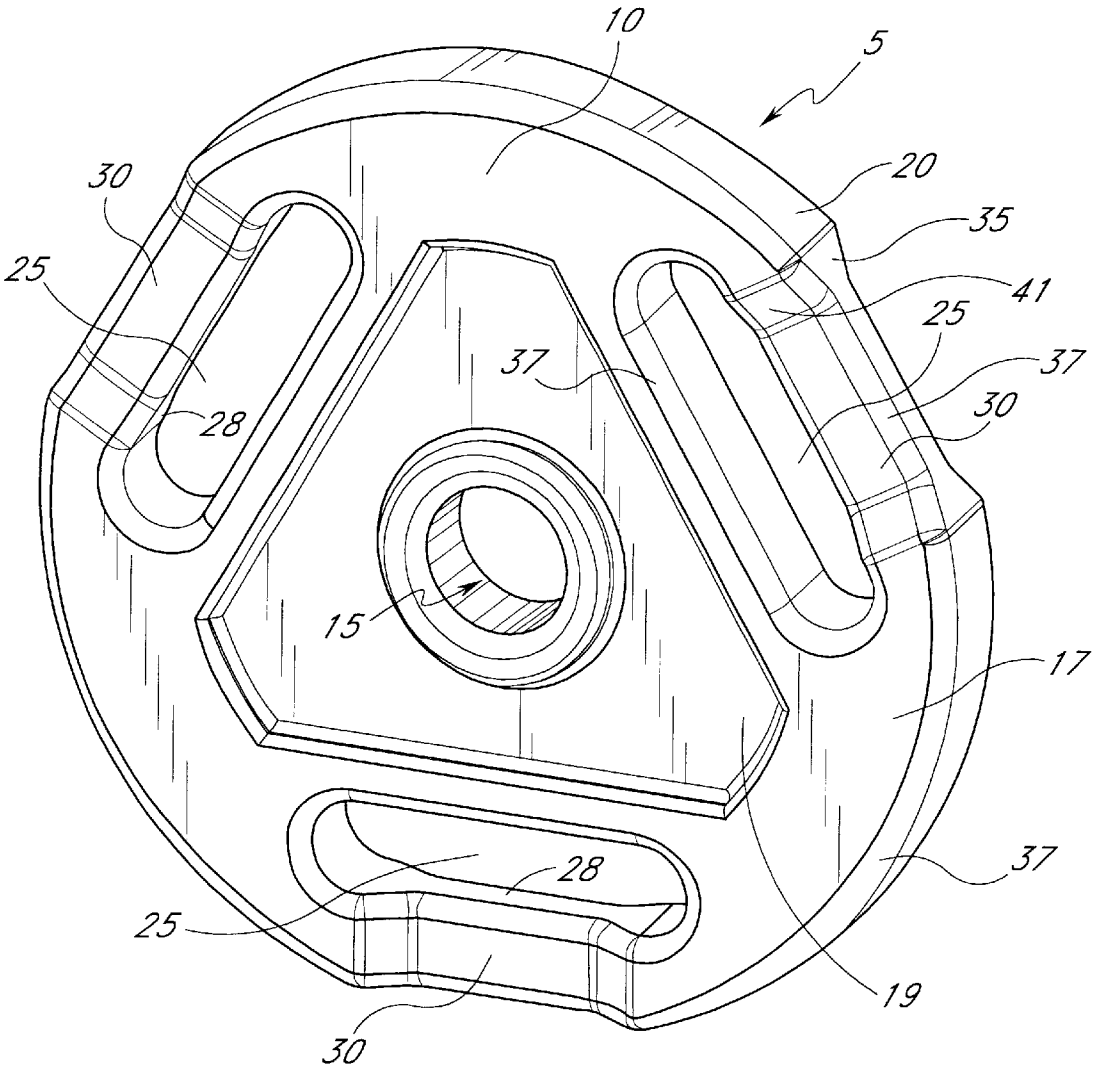
FIG. 1 shows a frontal perspective view of a barbell weight plate constructed in accordance with the present invention.
Figure 2:
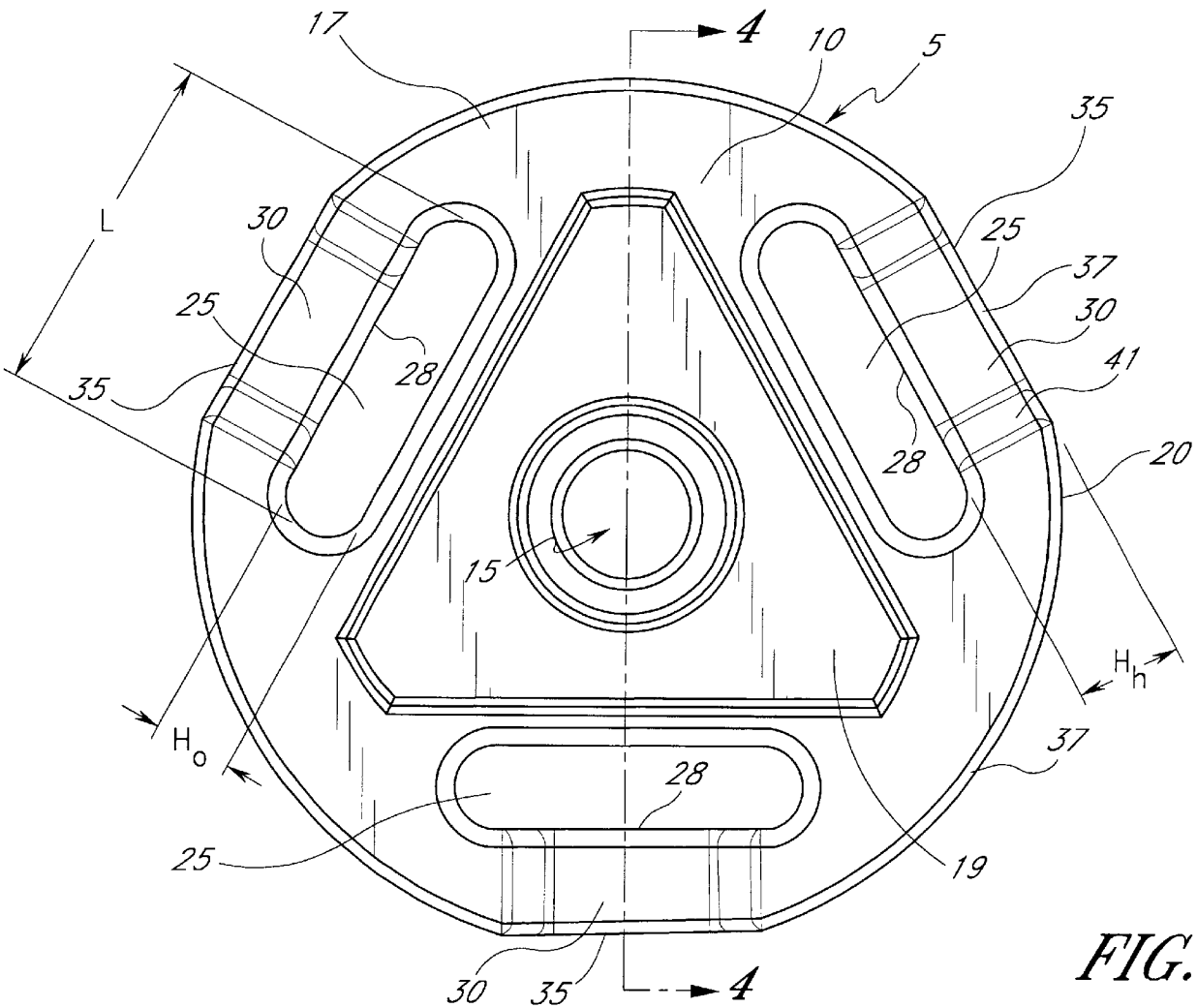
FIG. 2 shows a front plan view of the barbell weight plate of FIG. 1.

FIGS. 1 and 2 show one embodiment of a barbell weight plate constructed in accordance with the present invention. The weight plate 5 is a generally circular disk 10 having a central bore 15 and a peripheral surface 20. While the disclosed embodiment is a generally circular disk, it should be understood that the weight plate of the present invention could similarly be formed of virtually any disk shape, including triangular, rectangular or multi-sided disks, without affecting the utility of the present invention.

The central bore 15 is sized to accommodate a support bar of a barbell (not shown) in a manner well known to those of ordinary skill in the art. The weight plate additionally incorporates one or more openings 25, which are spaced from, but located in proximity to, the peripheral surface 20. The openings 25 are desirably elongated ovular openings, having an outer edge 28 which is substantially flat and perpendicular to the central bore 15 of the weight plate 5. Of course, other shapes for the openings may be used, including rectangular or circular openings. Between the openings 25 and the peripheral surface 20 are handgrips 30, formed integrally with the circular disk 10.

The outer edge 35 of the handgrips 30 are desirably flat, such that they are parallel to the outer edge 28 of each respective opening 25. Accordingly, the height H of the handgrip remains constant, which allows the weight lifter to maintain a secure grip on the handgrip. The outer edge 35 of the handgrips 30 transition smoothly from and to the curved peripheral surface 20 of the weight plate 5. The edges 37 of the peripheral surface 20 of the weight plate, and the inside surface of the openings 25 adjacent the handgrips 30, are beveled. This provides smooth edges for the weight plate 5 and reduces the overall outer dimensions of the handgrips 30. Of course, the handgrips 30 could be configured in various other cross-sectional shapes, including cylindrical, rectangular, or triangular cross-sections, or could even incorporate grooves for the individual fingers of the weight lifter's hand.

Figure 3:
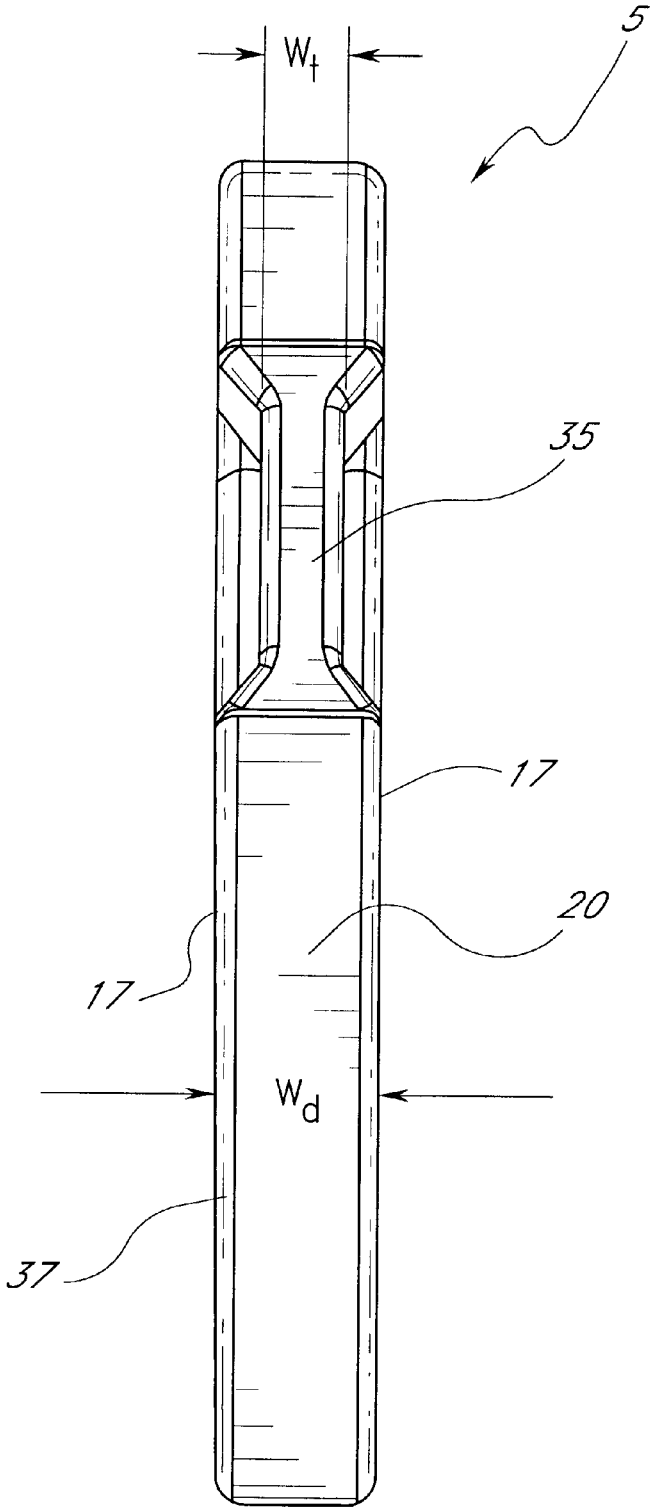
FIG. 3 shows a right side view of the barbell weight plate of FIG. 2.
Figure 4:
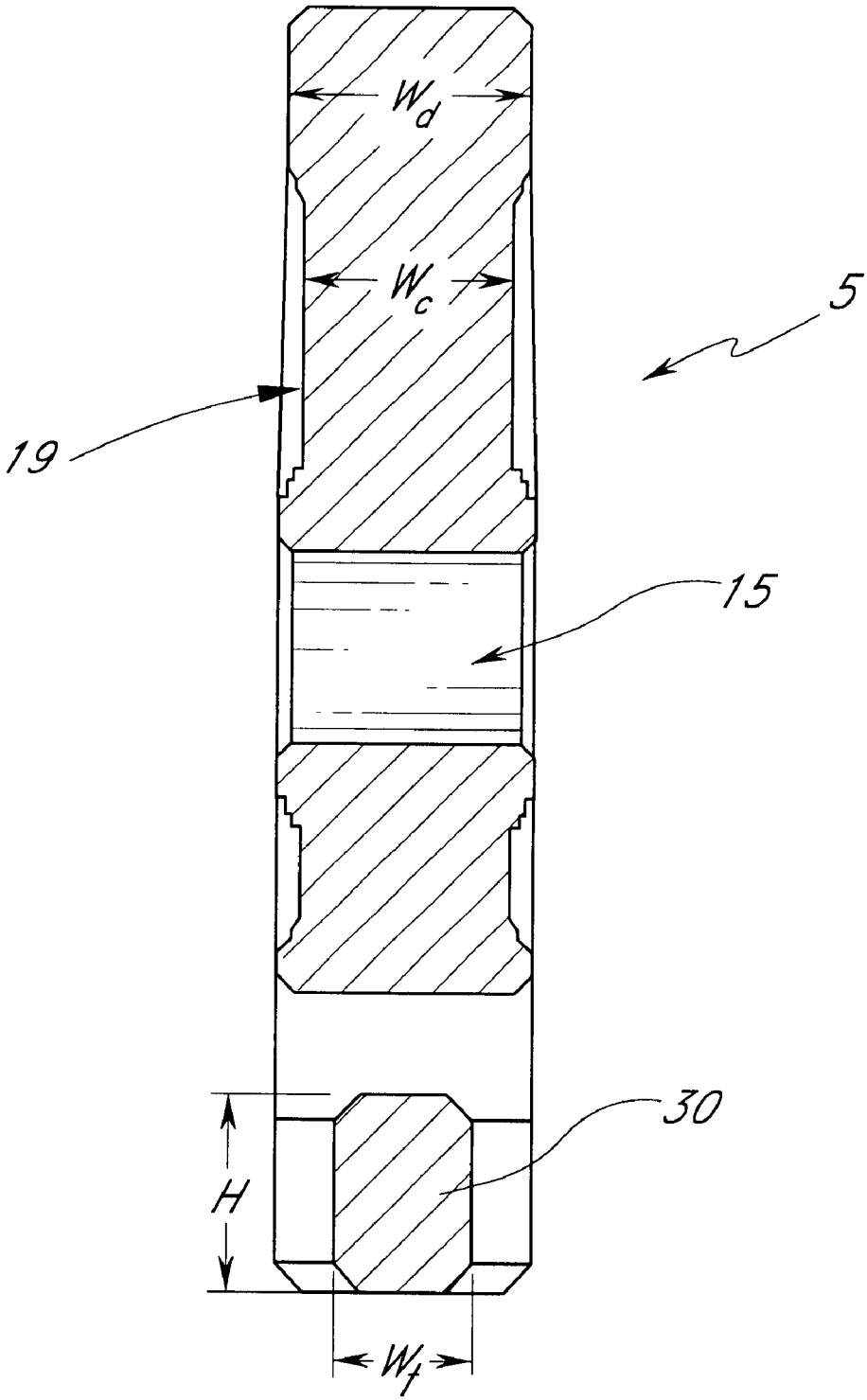
FIG. 4 shows a sectional view of the barbell weight plate of FIG. 2, taken along line 4—4.

As can be best seen from FIG. 3, the handgrips 30 have a transverse width Wt, which is thinner than the transverse width Wd of the weight plate. As seen in FIG. 4, the weight plate 5 preferably has a central field portion 19 having a transverse width Wc that is different than both the handgrip transverse width Wt and the weight plate transverse width Wd. In the embodiment shown, the body central field portion 19 transverse width Wc is greater than the handgrip transverse width Wt, but less than the weight plate transverse width Wd. The thinner transverse width Wt of the handgrip allows the weight lifter's hands and/or fingers to be substantially recessed when gripping the weight plate 5, such that the solid portions of the weight lifter's hands and/or fingers (i.e., the hand and finger bones) are at or below the outer face 17 of the weight plate 5. If the weight plate strikes a solid obstruction along its outer face 17, the outer face 17 of the weight plate 5 will absorb the majority of the impact without seriously damaging the solid portions of the weight lifter's hands and/or fingers.

A 25 pound weight plate, constructed in accordance with a preferred embodiment of the present invention, is advantageously a generally circular disk approximately 13.125 inches in diameter, with a transverse disk thickness Wd of approximately 1.875". The central bore of the weight plate is a concentric opening approximately 2" in diameter, which is sized to accommodate a standard size barbell support bar. Three openings 25 are positioned approximately 120° apart from each other, and are elongated ovular openings with a length L of approximately 5.25" and a height Ho of approximately 1.25".

The handgrip 30, formed between the openings 25 and the peripheral surface 20, desirably has a height Hh of approximately 1½" and a transverse width Wt of approximately 1". The outer edge 35 of the handgrip 30 is an approximately 4" flat surface which is perpendicular to the central bore 15 of the weight plate 5.

The dimensions of the disclosed handgrip 30 desirably permit a weight lifter to grip the handgrip by wrapping his or her thumb around one side of the handgrip, and then inserting his or her fingers into the opening(s) 25 and curling the fingers around the handgrip 30, such that his or her fingertips contact the edge of the handgrip opposite the weight lifter's palm. This results in a very strong grip on the weight which not only gives the weight lifter a greater feeling of security, but also greatly reduces the chance of the weight slipping out of the weight lifter's grasp. Furthermore, the present invention allows the manufacture of weight plates of increasing sizes without significantly increasing the dimensions of the handgrips, thereby allowing weight lifters with even very small hands to conveniently and safely manipulate even the heaviest of weight plates. Of course, the dimensions of the handgrips could also be further reduced to accommodate extremely small hands, if so desired.

The transverse width Wt of the handgrip 30 is thinner than the width Wd of the weight plate 5 at its periphery. Where the outer face 17 of the weight plate 5 meets the handgrips 30, the sides of the weight plate are tapered from the width Wd to the width Wt. These tapers 41 provide a gradual transition from the thicker width Wd of the weight plate to the thinner width Wt of the handgrip, which encourages the weight lifter to grasp the handgrips at their thinnest portions, thereby reducing the possibility of the weight lifter's hand being in contact with the outer face or a corner of the weight plate if the weight plate strikes a solid obstruction. This significantly reduces the chance of pinching the hand and/or fingers of a weight lifter who is grasping the weight plate. Desirably, the width Wt of the handgrips 30 should be at least ½" thinner than the transverse width Wd of the weight plate 5, which will resulting in the outer face 17 of the weight plate overlapping each side of the handgrips 30 by at least ¼". A weight lifter lifting such a weight plate by the handgrips will not have his or her hands and fingers projecting significantly beyond the outer face of the weight plate as they would in prior art weight plates. Of course, the handgrips may be thicker or thinner, depending upon the desired handle geometry and the convenience of the weight lifter. For example, by reducing the transverse thickness of the handgrip, but maintaining the transverse thickness of the weight plate, the overlap would be increased (thereby increasing safety for the weight lifter) while the circumference of the handgrips would be reduced (to accommodate the smaller hands of petite women or even children).

When a weight lifter manipulates a weight plate constructed in accordance with the present invention, he or she will grasp the weight plate by the handgrips, positioning his or her hand along the side of the handgrip, with the fingers curling through the opening and possibly extending along the opposite side of the handgrip. If the weight plate comes in contact with a solid obstruction, the weight lifter's hand and/or fingers will not be severely pinched between the weight plate and the obstruction, as would occur with prior art weight plates, but will rather only be "squeezed" between the handgrip and the obstruction before the projecting portions of the weight plate contact the obstruction, thereby stopping further squeezing of the weight lifter's hand and/or fingers. Accordingly, the gap formed by the reduced width of the handgrip will prevent the bones of the hand and/or fingers from being severely injured by the impact. Moreover, the joints of the weight lifter's hand and/or fingers are similarly protected from being pinched between the weight plate and the obstruction.

Figure 5:
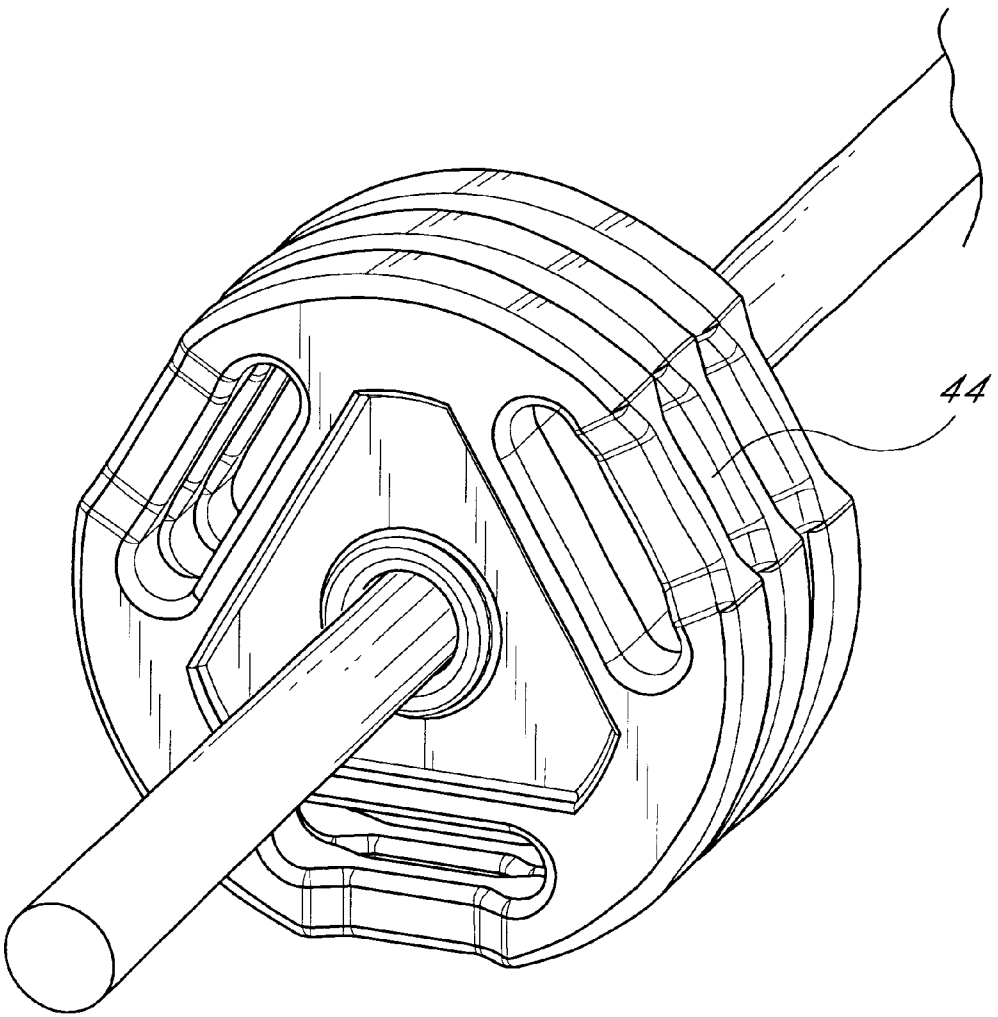
FIG. 5 shows a front perspective view of a plurality or "stack" of barbell weight plates constructed in accordance with the present invention.
Figure 6:
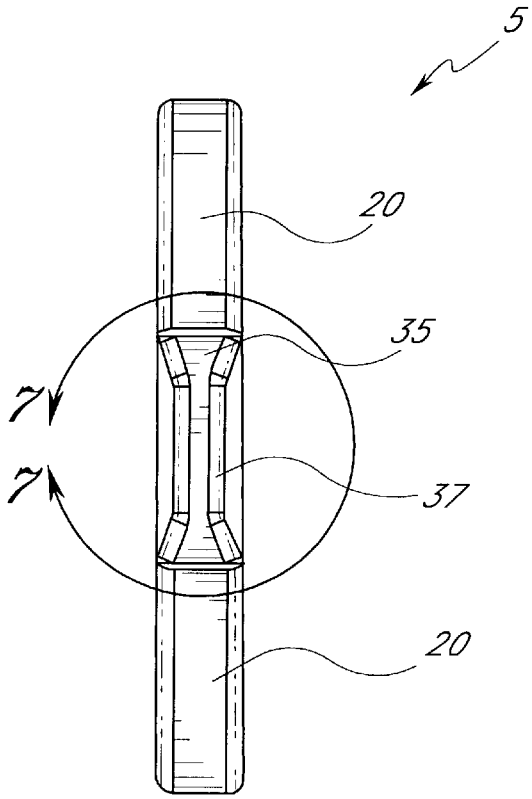
FIG. 6 shows a bottom plan view of the barbell weight plate of FIG. 2.
Figure 7:
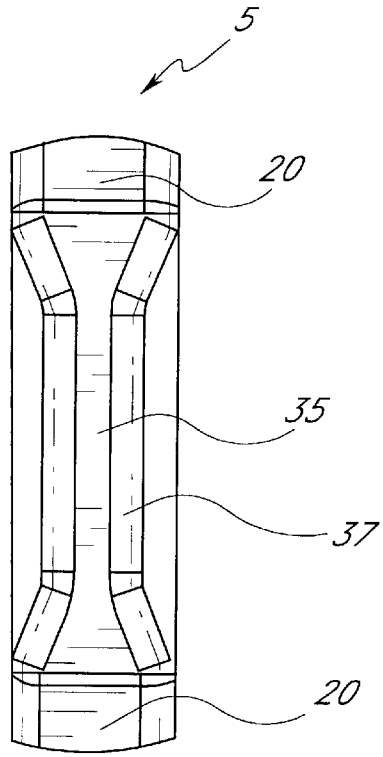
FIG. 7 shows an enlarged partial bottom plan view of the barbell weight plate of FIG. 6, taken along line 7.
Figure 8:
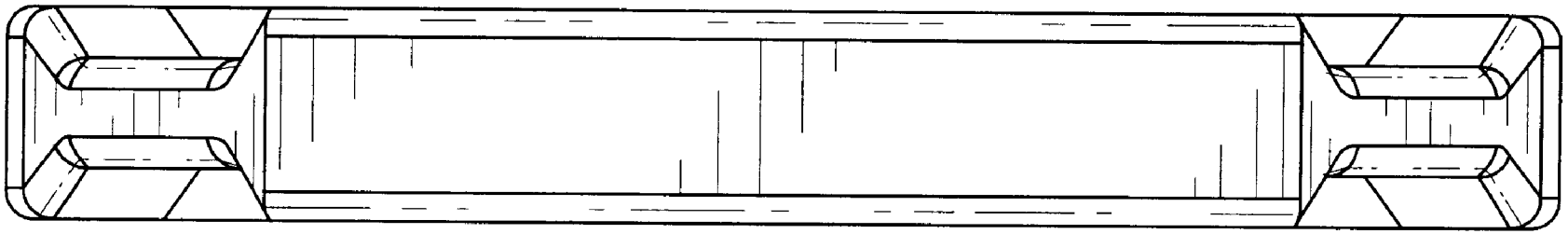
FIG. 8 shows a top plan view of the barbell weight plate of FIG. 2.
Figure 9:
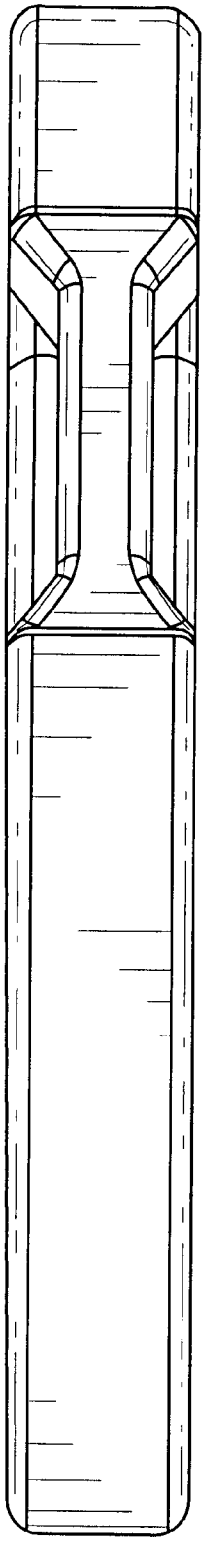
FIG. 9 shows a left side view of the barbell weight plate of FIG. 2.
Figure 10:
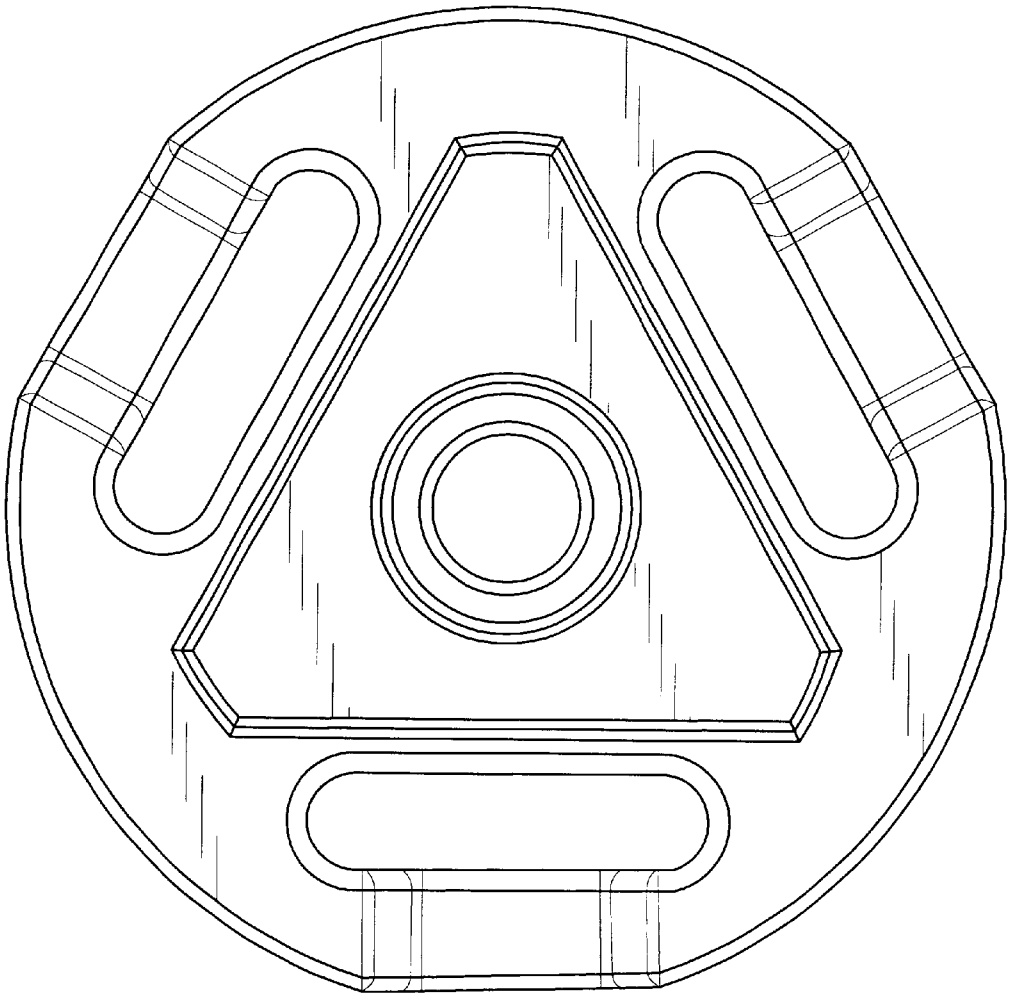
FIG. 10 shows a rear plan view of the barbell weight plate of FIG. 2.

FIG. 5 shows a barbell holding multiple weight plates, otherwise known as a "stack" of weights. Because the handgrips are thinner than the transverse width Wd of the weight plates, when the weight plate abuts against a solid obstruction, a gap or space will exist between the handgrip and the obstruction. When two adjacent weight plates are oriented such the handgrips on each weight plate are aligned, such as depicted in FIG. 5, this gap 44 is even more pronounced, thereby effectively doubling the distance between adjacent handgrips and further increasing the safety for the weight lifter's hands and fingers. If such orientation is desired, interlocking projections can be formed on the sides of the weight plates to bias the weight plates with respect to each other in a manner well known to those of ordinary skill in the art.

The present invention also facilitates the removal of weights from such a weight stack. Because the handgrips of the present invention are offset from the adjacent solid surface or adjacent weight plate, a weight lifter can easily insert his or her fingers into one or more of the gaps 44, can then conveniently pull the weight towards the end of the support bar, and then safely lift the weight plate off the support bar without removing his or her hands from the handgrips. Moreover, where the weights are stored on a tilted support bar, the present invention allows the weight lifter to easily grip the handgrips of the weight in its stored position, and then lift the weight plate and slide it up along the support bar without requiring additional steps such as working his or her fingers between the close edges of the plates.

In a similar manner, the present invention will allow a weight lifter to easily heft and move weight plates lying flat on the ground. As previously mentioned, when prior art weight plates were resting flat on the ground, there was no projecting edge or indentation that a weight lifter could use to gain purchase on the circumferential edge of the weight plate prior to lifting it off the ground. This forced the weight lifter to attempt to work his or her fingers under the edge of the weight plate, or to try and lift the weight plate using frictional forces on the circumference, often with less than favorable results. In contrast, the present invention provides an easily accessible indentation or gap between the floor and the handgrip, which can be used even when the weight plate is lying flat on its face. The weight lifter need merely insert his or her fingers into the gap between the handgrip and the floor, and then easily lift the weight plate off the floor.

The geometry of the present invention also greatly facilitates transport of the weight plate through the exercise facility. It is well known in the weight lifting art that the orientation of a weight lifter's hands during lifting exercises can significantly affect which muscle groups are actually exercised. For example, in performing a "Frontal Dumbbell Raise" exercise, a weight lifter will completely extend his or her arm downward, will grasp a dumbbell in the extended hand with the palm facing downward, will maintain his or her arm in the extended position while lifting the dumbbell in front of him/her, and will raise the dumbbell until it is in front of the weight lifter, even with his or her chin. During this exercise, the weight lifter will maintain his or her hand palm in a downward orientation, with the longitudinal axis of the dumbbell bar parallel to the floor. This orientation allows the weight lifter to utilize both shoulder and back muscles, in conjunction, to lift the weight.

If, however, the weight lifter rotates his or her hand approximately 90°, so that the palm of the hand faces towards the side, and the longitudinal axis of the dumbbell bar is perpendicular with respect to the floor, the change in hand orientation significantly alters the relationship between the shoulder and back muscles. In this orientation, the weight lifter's back muscles will contribute significantly less effort to lift the weight, thus forcing the shoulder muscles to bear a larger share of the load. This results in increased stress on the shoulder muscles and, more significantly, increased stress on the rotator cuff in the shoulder. Furthermore, because only the shoulder muscles are being used to lift the weight, the weight lifter will be able to lift less weight, even though the basic motion of the exercise has not changed.

The same result occurs when a weight lifter manipulates weight plates in a gym. Because prior art weight plates having handgrips position these handgrips diametrically opposed to each other (oriented 180° apart), a weight lifter seeking to lift such a weight plate using two hands (and thus both handgrips) is forced to orient his or her hands along the vertical axis rather than along the much more efficient horizontal axis, resulting in increased stresses in the shoulder muscles and rotator cuff when moving the weight plate.

By shifting the longitudinal axis of the handgrips away from the horizontal axis, the weight plate of the present invention significantly reduces stresses experienced by the weight lifter in the shoulder muscles and rotator cuff of the shoulder joint. Thus, the weight lifter is able to more easily move weight plates, or lift heavier weight plates, with less effort than with prior art weight plates, while still using the handgrips to grasp the weight plate.

The orientation of the handgrips in the present invention also allows the weight plate to be more safely used as an individual exercise device. For example, if a weight lifter desired to simulate a "front dumbbell raise" using both hands and the hand holder of a prior art weight plate, the weight lifter would have to grasp the diametrically opposed handgrips, thus orienting his or her hands along the vertical axis when performing the exercise. While the weight lifter would experience the added safety of using the handgrips, he or she would also be forced to position his or her hands at the less-than optimal vertical orientation, thus dramatically increasing stresses in the shoulders. This would result in less than optimal results.

The weight plate of the present invention allows a weight lifter to more safely perform such exercises. When the weight lifter wishes to simulate a "front dumbbell raise" using a weight plate, the weight lifter need merely grasp the weight plate by two of the handgrips, and then lift the weight plate in front of him/her in the manner previously described. The angled orientation of the handgrips allows the weight lifter to exercise both the back and shoulder muscles with minimal stresses on the shoulder joints.

In addition, by incorporating additional handgrips into alternate embodiments, the present invention would provide weight lifters with various handgrip orientations, thereby allowing the weight lifter to choose various hand positions and focus his or her exercise on various desired muscle groups. For example, a weight plate constructed in accordance with the present invention, having five handgrips oriented 72° apart, would also provide a weight lifter with convenient gripping surfaces located 144° or 216° apart. Also, a weight plate could have handgrips positioned asymmetrically about the central mounting hole.

The geometry of the present invention also limits movement of the barbell and/or dumbbell when placed on a flat surface such as the floor of the exercise facility. Because the generally circular circumference of the weight lifting plate incorporates generally flat surfaces adjacent the handgrips, these flat surfaces tend to resist circumferential rolling of the weight plate, and thus serve to limit movement of the barbell and/or dumbbell containing such weight plates. Accordingly, the present invention will prevent unwanted rotation and/or movement of a barbell and/or dumbbell when the barbell and/or dumbbell has been placed on a flat surface in the exercise facility.

The invention has been described with particular reference to certain preferred embodiments. Of course, various obvious modifications can be made without departing from the spirit of the invention and such modifications are intended to be within the scope of the following claims, either literally or under the doctrine of equivalents, whether or not expressly described in the above text or illustrated in the accompanying drawings.

What is claimed is:

1. An apparatus for use in physical fitness, comprising:

a weight plate having a central mounting hole passing transversely through the plate;

said plate having a peripheral surface;

said plate having a plurality of elongated openings spaced angularly around the central mounting hole and located between said central mounting hole and said peripheral surface; and a plurality of handgrips formed integrally with said plate, each of said handgrips sized and adapted to comfortably accommodate a user's hand and being located between one of said elongated openings and said peripheral surface; wherein the angular spacing between the centers of each of the elongate openings is less than 180°; and said peripheral surface of said plate is generally flat at locations adjacent to said handgrips and arcuate between the flat locations.

2. The apparatus of claim 1, wherein:

said handgrips have an octagonal cross-section.

3. The apparatus of claim 1, wherein:

said handgrips have a rectangular cross-section.

4. The apparatus of claim 1, wherein:

said handgrips have a circular cross-section.

5. The apparatus of claim 1, wherein:

said weight plate has beveled edges along said handgrips.

6. The apparatus of claim 1, wherein:

said plate is comprised of iron.

7. The apparatus of claim 6, wherein:

said iron plate is coated with rubber.

8. The apparatus of claim 6, wherein:

said iron plate is chrome plated.

9. The weight plate of claim 1, wherein said plurality of openings comprises three openings; and each opening has a center located at an angle of approximately 120° with respect to each other.

10. The weight plate of claim 9, wherein the weight plate has a first transverse width in an area between the openings;

said three handgrips each having a second transverse width, and said second transverse width is less than said first transverse width.

11. The weight plate of claim 10, wherein the difference between the first and second transverse widths is large enough to accommodate the bony portions of a human hand.

12. The weight plate of claim 11, wherein the difference between the first and second transverse widths is at least 2 inch.

13. The weight plate of claim 1, wherein the elongate opening has a substantially flat surface at the handgrip, and the elongate opening surface is longer than the flat portion of the peripheral surface.

14. The weight plate of claim 13, wherein the elongate opening has a pair of substantially parallel elongate surfaces, and the parallel surfaces have substantially the same lengths.

15. The weight plate of claim 14, wherein the parallel surfaces each have first and second ends, and a first arcuate surface extends between the first ends of the parallel surfaces and a second arcuate surface extends between the second ends of the parallel surfaces.

16. The weight plate of claim 1, wherein a first flat surface is formed on the perimeter surface at one of the handgrips and a second flat surface is formed on a side of the handgrip facing the elongate opening, and the second flat surface is longer than the first flat surface.

17. A dual-purpose weight plate, comprising:

a generally disk-shaped plate having a centrally-positioned opening adapted to accommodate a weight lifting barbell; and a plurality of elongate handles integrally formed with the plate, each handle located adjacent an elongate opening extending through the plate, and each handle additionally having a center, the centers angularly spaced less than 180° from each other handle center and less than 120° from at least one other handle center so that when a weight lifter grasps the plate by any two handles when the plate is generally vertically oriented, both hands of the weight lifter can simultaneously be oriented with the palm facing at least partially downward, and the weight lifter can selectively choose between at least two possible hand orientations depending on which two handles the weight lifter grasps;

wherein the weight plate is adapted to be used with the barbell and is also adapted to be used alone to simultaneously utilize the shoulder and back muscle groups of the weight lifter when lifted using two handles.

18. The weight plate of claim 17, wherein:

each elongate handle has a substantially uniform transverse width.

19. The weight plate of claim 17, wherein each of the elongate handles has a longitudinal axis, and the angle formed by the axes of two adjacent elongate handles is about 60°.

20. The weight plate of claim 17, wherein each of the elongate handles has at least one flat surface portion.

21. An apparatus for use in physical fitness, comprising:

a weight plate having a central mounting hole passing transversely through the plate;

said plate having a peripheral surface;

said plate having three elongated openings spaced angularly around the central mounting hole and located between said central mounting hole and said peripheral surface;

three handgrips formed integrally with said plate, each of said handgrips sized and adapted to comfortably accommodate a user's hand and being located between one of said elongated openings and said peripheral surface; and the angular spacing between the center of one of the elongate openings and the center of the closest adjacent elongate opening is approximately 120°;

wherein said peripheral surface of said plate is generally flat at locations adjacent to said three handgrips and arcuate between the flat locations.

22. The weight plate of claim 21, wherein the weight plate has a first transverse width in an area between the openings;

said three handgrips each having a second transverse width, and said second transverse width is less than said first transverse width.

* * * * *